US009728882B1

(12) United States Patent
Nakazawa

(10) Patent No.: US 9,728,882 B1
(45) Date of Patent: Aug. 8, 2017

(54) CONNECTOR

(71) Applicant: Molex, LLC, Lisle, IL (US)

(72) Inventor: Nozomu Nakazawa, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/471,761

(22) Filed: Mar. 28, 2017

(30) Foreign Application Priority Data

May 13, 2016 (JP) ..... 2016-097046

(51) Int. Cl.
*H01R 12/00* (2006.01)
*H01R 13/115* (2006.01)
*H01R 13/193* (2006.01)

(52) U.S. Cl.
CPC ..... *H01R 13/115* (2013.01); *H01R 13/193* (2013.01)

(58) Field of Classification Search
CPC ..... H01R 13/115; H01R 13/193
USPC ..... 439/74, 660, 682
See application file for complete search history.

(56) References Cited

U.S. PATENT DOCUMENTS 7,901,218 B2 * 3/2011 Sato ..... H01R 12/716 439/74
7,985,099 B2 * 7/2011 Wu ..... H01R 12/57 439/626
8,342,875 B2 * 1/2013 Takeuchi ..... H01R 12/716 439/374
9,039,428 B2 * 5/2015 Sasaki ..... H01R 13/631 439/74
9,577,380 B1 * 2/2017 Zhao ..... H01R 12/716

FOREIGN PATENT DOCUMENTS

JP 2004-119048 A 4/2004

* cited by examiner

*Primary Examiner* — Khiem Nguyen
(74) *Attorney, Agent, or Firm* — James A. O'Malley

(57) ABSTRACT

A first contact part of a first terminal includes a linear part extending linearly in an insertion direction of an insertion protrusion, and a termination part of the linear part; and a first contact part of a second terminal includes a linear part extending linearly in an insertion direction of an insertion protrusion, and a termination part of the linear part; where, when an insertion protrusion is inserted into an insertion recess such that a first connector and a second connector achieve a completely mated state, the termination part of the linear part of the first contact part of the second terminal is positioned more in front of the insertion direction of the insertion protrusion than the termination part of the linear part of the first contact part of the first terminal.

4 Claims, 7 Drawing Sheets

CONNECTOR

RELATED APPLICATIONS

This application claims priority to Japanese Application No. 2016-097046, filed May 13, 2016, which is incorporated herein by reference in its entirety.

TECHNICAL FIELD

The present disclosure relates to a connector.

BACKGROUND ART

Conventionally, connectors such as board to board connectors, and the like, have been used to electrically connect pairs of parallel circuit boards together. These kinds of connectors, are attached to each mutually facing surface on pairs of circuit boards, and are mated together so as to be connected (see, for example, Patent Document 1).

FIG. 7 is a cross sectional view illustrating a conventional connector.

In the figure, 811 is a first housing of a first connector mounted on a first circuit board 891, and 911 is a second housing of a second connector mounted on a second circuit board 991. The first circuit board 891 and the second circuit board 991 are electrically connected by mating the first connector and the second connector together. Furthermore, a first terminal 861 is attached to the first housing 811, and a second terminal 961 that is in contact with the first terminal 861 is attached to the second housing 911.

The terminal 861 is provided with a first contact part 865 and a second contact part 866 that mutually face one another, and a connecting part 864 for connecting the first contact part 865 and the second contact part 866. Moreover, when the first connector and the second connector are mated together, the second terminal 961 is clamped from both sides by the first contact part 865 and the second contact part 866, as illustrated in the figure, which sustains contact between the first terminal 861 and the second terminal 961.

Note that because the second connector rises relative to the first connector when the mating between the first connector and the second connector is released, there is a risk that the first contact part 865 positioned on a free end of the first terminal 861 will be dragged and wound up by a first contact part 965 of the relatively rising second terminal 961. However, because an overhanging part 813*a* protruding from an upper end of an island part 813 positioned in the center of the width direction of the first housing 811 overlaps the first contact part 865 from above, the first contact part 865 is prevented from moving upward, and thus prevented from being wound up.

Patent Document 1: Japanese Unexamined Patent Application Publication No. 2004-119048

SUMMARY

However, when the second connector is raised relative to the first connector in a state where force is applied that inclines the first connector and the second connector with respect to one another in the width direction when the mating is released in the conventional connector, the first contact part 865 may become wound up.

Because the first contact part 965 of the second terminal 961 rises relatively in an obliquely inclined state when force is applied such that the second connector inclines in the width direction relative to the first connector, the first contact part 865 of the first terminal 861 is lifted by the inclined first contact part 965, and is thus subjected to a very large upward force. Therefore, the overhanging part 813*a* of the first housing 811 that overlaps the first contact part 865 from above is unable to resist the upward force, and deforms or is broken, and thus the first contact part 865 is wound up.

Thus, an object herein is to solve the conventional problems described above by providing a highly reliable connector where a first terminal is not wound up even when a force is applied such that a second connector is inclined in the width direction relative to a first connector.

Therefore, a connector is provided with: a first connector that includes a first terminal, and a first housing in which an insertion recess in which the first terminal is disposed is formed; and a second connector that includes a second terminal in contact with the first terminal, and a second housing in which the second terminal is disposed, and in which an insertion protrusion to be inserted into the insertion recess is formed, where the first terminal includes a first contact part disposed on one side surface of the insertion recess and a second contact part disposed on the other side surface of the insertion recess; the first contact part includes a linear part extending linearly in an insertion direction of the insertion protrusion, and a termination part of the linear part; the second terminal includes a first contact part disposed on one side surface of the insertion protrusion and in contact with the first contact part of the first terminal, and a second contact part disposed on the other side surface of the insertion protrusion and in contact with the second contact part of the first terminal; and the first contact part includes a linear part extending linearly in an insertion direction of the insertion protrusion, and a termination part of the linear part, and where, when the insertion protrusion is inserted into the insertion recess and the first connector and the second connector are in a completely mated state, the termination part of the linear part of the first contact part of the second terminal is positioned more in front of the insertion direction of the insertion protrusion than the termination part of the linear part of the first contact part of the first terminal.

Furthermore, in another connector, the first contact part of the first terminal has a substantially J shape, and the termination part of the linear part of the first contact part is a free end that does not make contact with the first contact part of the second terminal in the completely mated state.

Furthermore, in yet another connector, the first contact part of the first terminal includes a curved part that is in contact with an end part on the opposite side of the termination part of the linear part, and the first housing includes an overhanging part that is in contact with or in proximity to the curved part.

Furthermore, in yet another connector, the first terminal includes a first connecting part disposed in a bottom part of the insertion recess for connecting the first contact part and the second contact part, the second terminal includes a second connecting part disposed on a tip of the insertion protrusion for connecting the first contact part and the second contact part, and the first connecting part and the second connecting part are separated from one another in a completely mated state.

The connector provides high reliability such that a first terminal is not wound up even when a force is applied such that a second connector is inclined in the width direction with respect to a first connector when mating is released.

BRIEF DESCRIPTION OF THE DRAWINGS

FIG. 6A is a view illustrating a completely mated state of a first terminal and a second terminal, and FIG. 6B is a view illustrating the first terminal and the second terminal at the time the oblique removal is initiated.

DETAILED DESCRIPTION OF THE PREFERRED EMBODIMENTS

The embodiments are described in detail below with reference to the drawings.

Figure 1:
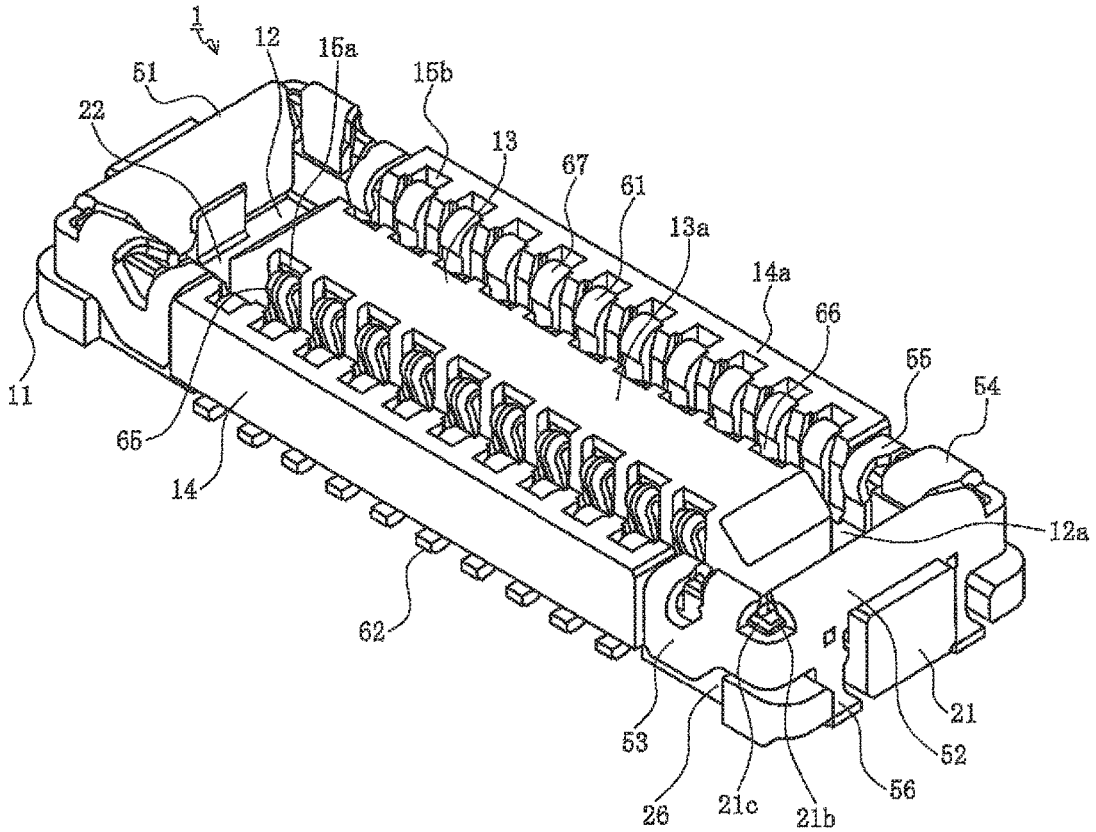
FIG. 1 is a perspective view observed from a mating surface side, which is a perspective view of a first connector of the present embodiment.

FIG. 1 is a perspective view observed from a mating surface side, which is a perspective view of a first connector of the present embodiment.

In the figure, 1 is a connector of the present embodiment, and is a first connector serving as one of a pair of board to board connectors. The first connector 1 is a surface mount type connector mounted on the surface of a first board not illustrated in the figure that serves as a mounting member, and is mated to a second connector 101 that serves as a counterpart connector to be described later. Furthermore, the second connector 101 is the second of the pair of board to board connectors, and is a surface mount type connector mounted on the surface of a second board not illustrated in the figure that serves as a mounting member.

Note that while the first connector 1 and the second connector 101 are ideally used for electrically connecting the first board and the second board serving as boards, the connectors can be used to electrically connect other members as well. While the first board and the second board are, for example, printed circuit boards, flexible flat cables (FC), flexible printed circuits (FPC), and the like, used in electronic equipment, the boards may also be any type of board.

Furthermore, expressions for indicating directions such as up, down, left, right, front, back, and the like, used to describe the operations and configurations of the parts of the first connector and the second connector in the present embodiment are not absolute but rather relative directions, and though appropriate when the parts of the first connector and the second connector are in the postures illustrated in the figures, these directions should be interpreted differently when these postures change, to correspond to said change.

Furthermore, the first connector 1 has a first housing 11 as a connector body integrally formed of an insulating material such as a synthetic resin, and the like. As illustrated in the figure, the first housing 11 is a substantially rectangular body having a substantially rectangular thick plate shape, where a substantially rectangular recess 12 surrounded by a periphery is formed on the side of the housing in which the second connector 101 fits, that is, on a mating surface side (upper side in FIG. 1). While the first connector 1 is, for example, approximately 7.0 mm high, approximately 2.5 mm wide, and approximately 0.6 mm thick in dimension, the dimensions can be changed as appropriate. Furthermore, a first protrusion 13, which serves as an island part inside the recess 12, is formed integrally with the first housing 11, moreover, a side wall 14 is formed integrally with the first housing 1 on both sides of the first protrusion 13, extending in parallel to the first protrusion 13.

In this case, the first protrusion 13 and the side wall 14 protrude upward from a bottom surface of the recess 12, and extend in the longitudinal direction of the first housing 11. This forms a concave groove 12*a*, as one part of the recess 12, on both sides of the first protrusion 13 to serve as an insertion recess, which is a long narrow recess extending in the longitudinal direction of the first housing 11. Note that while there is only one first protrusion 13 in the example illustrated in the figure, there may be several or any number of such protrusions. Furthermore, while the first protrusion 13 is, for example, approximately 0.4 mm wide in dimension, this dimension can be changed as appropriate.

Here, a recessed groove shaped first terminal accommodating inner cavity 15*a* is formed on side surfaces on both sides of the first protrusion 13. Moreover, a recessed groove shaped first terminal accommodating outer cavity 15*b* is formed on an inner side surface of the side wall 14. Furthermore, because the first terminal accommodating inner cavity 15*a* and the first terminal accommodating outer cavity 15*b* are integrally connected to one another on a bottom surface of the concave groove 12*a*, the first terminal accommodating inner cavity 15*a* and the first terminal accommodating outer cavity 15*b* are described as a first terminal accommodating cavity 15 when described integrally.

The first terminal accommodating cavity 15 is formed 10 cavities at a time at a pitch of, for example, approximately 0.2 mm on both sides of the first protrusion 13. Furthermore, a first terminal 61 accommodated in each of the first terminal accommodating cavities 15 is also disposed 10 terminals at a time at a pitch of, for example, 0.2 mm on both sides of the first protrusion 13. Note that the pitch and quantity of the first terminal accommodating cavity 15 can be changed as appropriate.

The first terminal 61 is a member formed integrally by applying processes such as punching, bending, and the like, to a conductive metal plate, and is provided with a part to be held 63 described below, a tail 62 connected to a lower end of the part to be held 63, an upper connecting part 67 connected to an upper end of the part to be held 63, a second contact part 66 connected to an inner end of the upper connecting part 67 and disposed on a side surface on the side wall 14 side in the concave groove 12*a*, a lower connecting part 64 connected to a lower end of the second contact part 66 as a first connecting part to be described below disposed in a bottom part of the concave groove 12*a*, an inner connecting part 68 to be described below connected to an inner end of the lower connecting part 64, and a first contact part 65 connected to an upper end of the inner connecting part 68 and disposed on an inner surface on the first protrusion 13 side in the concave groove 12*a*.

The part to be held 63 is a part that extends in a vertical direction, that is, in the thickness direction of the first housing 11, and is mated into the first terminal accommodating outer cavity 15*b*. Furthermore, the tail 62 is connected bent relative to the part to be held 63, extends outward in a horizontal direction, that is, in the width direction of the first housing 11, and is connected to a connection pad connected to a conductive trace of the first board by soldering, or the like. Note that the conductive trace is typically a signal line. Moreover, the upper connecting part 67 is connected bent with respect to the part to be held 63, and extends inward in the width direction of the first housing 11.

The second contact part 66 is a part connected bent with respect to the upper connecting part 67, and extends in the thickness direction of the first housing 11. Furthermore, the lower connecting part 64 is connected to a lower end of the second contact part 66, and extends inward in the width direction of the first housing 11. Moreover, the inner connecting part 68 is a part connected bent with respect to the lower connecting part 64, and extends in the thickness direction of the first housing 11. Furthermore, the first contact part 65 bent in a J shape and curved bulging outward in the width direction of the first housing 11, is formed on a free end of the inner connecting part 68, that is, in the vicinity of an inward upper end.

The first terminal 61 fits in the first terminal accommodating cavity 15 from a mounting surface side (lower side in FIG. 1), and the part to be held 63 is secured in the first housing 11 by being sandwiched from both sides by side walls of the first terminal accommodating outer cavity 15*b* formed on an inner side surface the side wall 14. In this state, that is, in a state where the first terminal 61 is loaded in the first housing 11, the first contact part 65 and the second contact part 66 are positioned to the left and right on both sides of the concave groove 12*a* facing one another.

Note that because the first terminal 61 is a member integrally formed by processing a metal plate, the terminal is somewhat elastic. Furthermore, as is obvious from the shape thereof, a distance between the first contact part 65 and the second contact part 66, which face one other, can vary elastically. That is, inserting a second terminal 161, described below and provided by the second connector 101, between the first contact part 65 and the second contact part 66 elastically expands the distance between the first contact part 65 and the second contact part 66.

Furthermore, each first protruding end part 21 is disposed on both longitudinal direction ends of the first housing 11 as a fit guiding part. A mating recess 22 is formed on each of the first protruding end parts 21 as part of the recess 12. The mating recess 22 is a substantially rectangular recess connected to both longitudinal direction ends of each of the concave grooves 12*a*. Furthermore, in a state where the first connector 1 and the second connector 101 are mated, a second protruding end part 122, described below and provided by the second connector 101, is inserted into the mating recess 22.

Furthermore, the first protruding end part 21 provides a side wall extension 21*c* extending in the longitudinal direction of the first housing 11 from both longitudinal direction ends of the side wall 14, and an end wall 21*b* extending in the width direction of the first housing 11 with both ends thereof being connected to the side wall extension 21*c*. The end wall 21*b* and the side wall extension 21*c* connected to both ends thereof form a continuous reverse C shaped side wall on each of the first protruding end parts 21, to form three sides of the substantially rectangular mating recess 22.

Moreover, a first reinforcing bracket 51 is attached to the first protruding end part 21 as a reinforcing bracket. The first reinforcing bracket 51 is housed and held in a first bracket holding recess 26 formed on the first protruding end part 21. In the present embodiment, the first reinforcing bracket 51 is a member formed integrally by applying processes such as punching, bending, and the like, to a conductive metal plate, and is provided with a long thin belt like connecting arm 53, a side guiding part 54 connected to an upper end of the connecting arm 53, a contact arm 55 also connected to an upper end of the connecting arm 53, and a board connecting part 56 connected to a lower end of the first body part 52.

The connecting arm 53 is elastically displaceable both vertically and horizontally. Furthermore, as for the pair of board connecting parts 56, the proximal ends thereof extend upward in the same surface as the first body part 52, and the free ends thereof are belt like plate members curved so as to face outward in the longitudinal direction of the first housing 11. Moreover, the lower end of the free end of the board connecting part 56 is connected to a connection pad connected to a conductive trace of the first board by soldering, or the like. Note that the conductive trace is typically a power line.

Furthermore, the side guiding part 54 and the contact arm 55 are members formed so as to cover an upper surface and inner wall surface of the side wall extension 21*c* in a state like that illustrated in FIG. 1, where the first reinforcing bracket 51 is attached to the first protruding end part 21. Furthermore, the proximal ends of the side guiding part 54 and the contact arm 55 are connected to an upper end of the connecting arm 53, while the distal ends thereof extend facing downward.

Because the apex of the first body part 52 and the apex of the side guiding part 54 are positioned higher than an upper surface 14*a* of the side wall 14 and an upper surface 13*a* of the first protrusion 13 in the example illustrated in the figure, the second protruding end part 122 of the second connector 101 does not first make contact with the side wall 14 and the first protrusion 13 when the first connector 1 and the second connector 101 are mated together. Accordingly, the side wall 14 and the first protrusion 13 are not damaged or broken.

The configuration of the second connector 101 will be described next.

Figure 2:
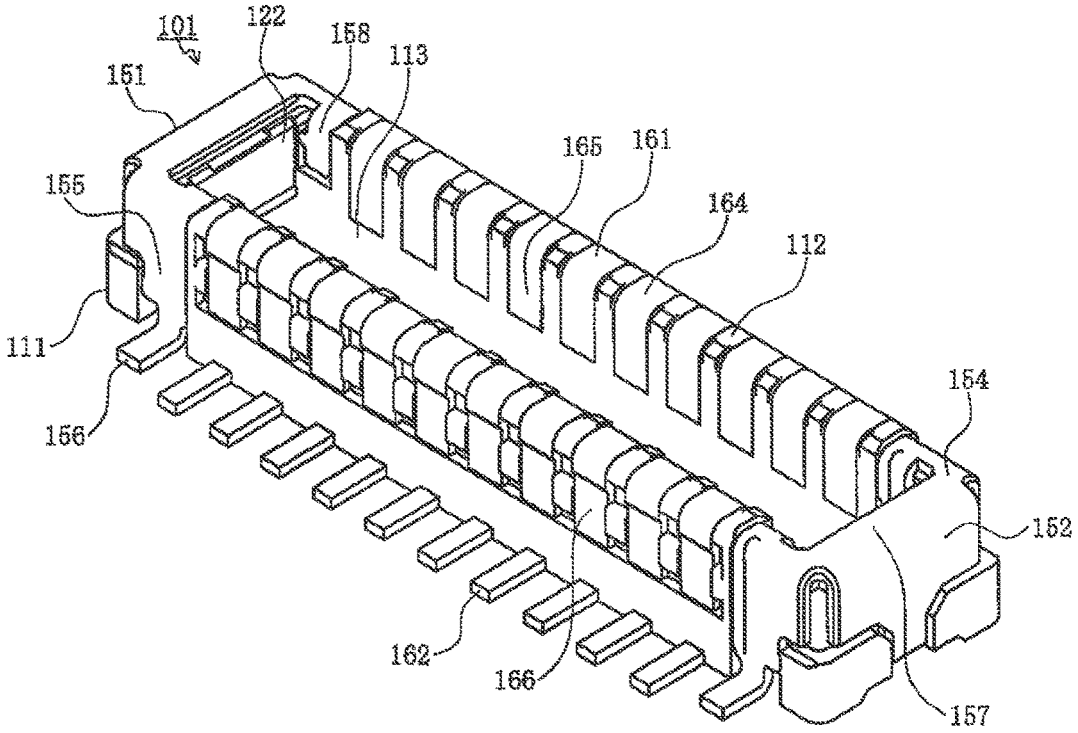
FIG. 2 is a perspective view observed from a mating surface side, which is a perspective view of a second connector of the present embodiment.

FIG. 2 is a perspective view observed from a mating surface side, which is a perspective view of a second connector in the present embodiment.

The second connector 101 has a second housing 111 as a counterpart connector body integrally formed of an insulating material such as a synthetic resin, and the like. As illustrated in the figure, while the second housing 111 is a substantially rectangular body with the shape of a substantially rectangular thick plate, and is, for example, approximately 5.0 mm high, approximately 1.5 mm wide, and approximately 0.5 mm thick in dimension, the dimensions can be changed as appropriate. Furthermore, a long narrow concave groove 113 extending in the longitudinal direction of the second housing 111, and a second protrusion 112 serving as an insertion protrusion, which is a long narrow protrusion extending in the longitudinal direction of the second housing 111, are formed integrally on the side where the second housing 111 fits into the connector 1, that is, the mating surface side (upper side in the figure). The second protrusion 112 is formed along both sides of the concave groove 113, and along both sides of the second housing 111. Moreover, the second terminal 161 is disposed in each of the second protrusions as a counterpart terminal.

As illustrated in the figure, the concave groove 113 is closed by a bottom part thereof on a side where the second board is mounted, that is, on a mounting surface (lower surface in the figure) side. Note that while there are two second protrusions 112 in the example illustrated in the figure, there may be only one or any number of these protrusions. Furthermore, while the concave groove 113 is, for example, approximately 0.7 mm wide in dimension, this dimension can be changed as appropriate.

The second terminal 161 is a member formed integrally by applying processes such as punching, bending, and the like, to a conductive metal plate, and is provided with a body part 163 to be described below, a tail 162 connected to an outer end of the body part 163, a first contact part 165 connected to an inner end of the body part 163 and disposed on an inner surface of the second protrusion 112, a connecting part 164 serving as a second connecting part connected to an upper end of the first contact part 165 and disposed on a tip of the second protrusion 112, and a second contact part 166 connected to an outer end of the connecting part 164 and disposed on an outer surface of the second protrusion 112.

Furthermore, the body part 163 is a part with at least a portion of the periphery thereof surrounded by and held in the second housing 111. Moreover, the tail 162 is connected in the horizontal direction of the body part 163, that is, to an outer end in the width direction of the second housing 111, protrudes outward from the second housing 111, and is connected to a connection pad connected to a conductive trace of the second board by soldering, or the like. Note that the conductive trace is typically a signal line.

Furthermore, the first contact part 165 is a flat plate like part connected bent with respect to the body part 163, extending in a vertical direction, that is, in the thickness direction of the second housing 111. Moreover, the connecting part 164 is connected bent with respect to the first contact part 165, and extends outward in the width direction of the second housing 111. Furthermore, the second contact part 166 is a part connected bent facing downward to an outer end of the connecting part 164, and that extends downward.

The second terminal 161 is integrated with the second housing 111 by over-molding or insert molding. That is, the second housing 111 is formed by filling a cavity of a mold, in which the second terminal 161 had been set beforehand, with resin. As a result, at least a part of the second terminal 161 is embedded in the second housing 111, and integrally attached to the second housing 111, in a state where the surfaces of the first contact part 165, the connecting part 164, and the second contact part 166 are exposed to each side surface of the second protrusion 112 and to the mating surface. In this case, the second terminal 161 is disposed horizontally 10 terminals at a time at a pitch of, for example, approximately 0.2 mm. Note that the pitch and quantity of the second terminal 161 can be changed as appropriate.

Furthermore, each of the second protruding end parts 122 is disposed on both longitudinal direction ends of the second housing 111 as a counterpart fit guiding part. The second protruding end part 122 is a thick member both ends of which are connected to both longitudinal direction ends of each of the second protrusions 112, extending in the width direction of the second housing 111, where an upper surface thereof has a substantially rectangular shape. Moreover, in a state where the first connector 1 and the second connector 101 are mated, the second protruding end part 122 is inserted into the mating recess 22 of the first protruding end part 21 provided by the first connector 1.

Furthermore, a second reinforcing bracket 151 is attached to the first protruding end part 122 as a counterpart reinforcing bracket. The second reinforcing bracket 151 is disposed along an outer surface of the second housing 111 of the second protruding end part 122, and a tip of a holding projection 158 thereof is accommodated and held on an inner side surface in the vicinity of both longitudinal direction ends of the second protrusion 112.

In the present embodiment, the second reinforcing bracket 151 is a member formed integrally by applying processes such as punching, bending, and the like, to a conductive metal plate, and is provided with a second body part 152 extending in the width direction of the second housing 111, a center cover 157 connected to an upper end of the second body part 152, a side cover 154 connected to both left and right ends of the center cover 157, the holding projection 158 connected to one side edge of the side cover 154, a contact side board 155 connected to the other side edge of the side cover 154, and a board connecting part 156 connected to a lower end of the contact side board 155.

The center cover 157 is a member shaped and sized to cover most of an upper surface of the second protruding end part 122, in a state like that illustrated in the figure where the second reinforcing bracket 151 is attached to the second protruding end part 122.

Furthermore, the side cover 154 extends in the longitudinal direction of the second housing 111 from both left and right ends of the center cover 157, and is a member for covering an upper surface in the vicinity of both longitudinal direction ends of the second protrusion 112. Moreover, the contact side board 155 is a member for covering an outer surface in the vicinity of both longitudinal direction ends of the second protrusion 112. Note that the side cover 154, and the holding projection 158 and the contact side board 155 attached to both side edges thereof, form a continuous U shape formed so as to continuously bridge an inner side surface of the second protrusion 112, an upper surface of the second protrusion 112, and an outer side of the second protrusion 112, in the vicinity of both longitudinal direction ends of the second protrusion 112.

Furthermore, the board connecting part 156 extends facing outward from the second housing 111, and is connected to a connection pad connected to a conductive trace of the second board by soldering, or the like. The conductive trace is typically a power line.

The operation for mating the first connector 1 and the second connector 101 together will be described next.

Figure 3:
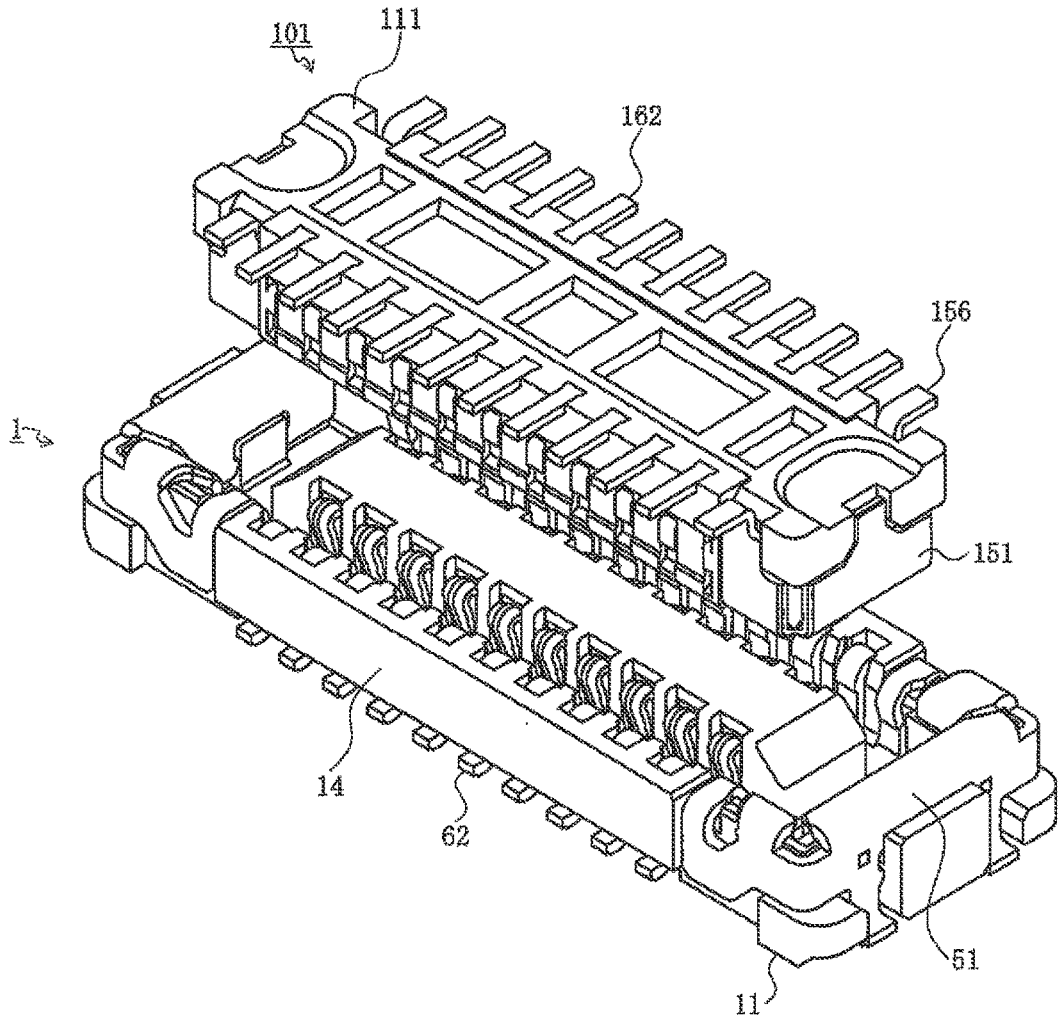
FIG. 3 is a perspective view illustrating the positional relationship between the first connector and the second connector of the present embodiment during a connector mating process.
Figure 4:
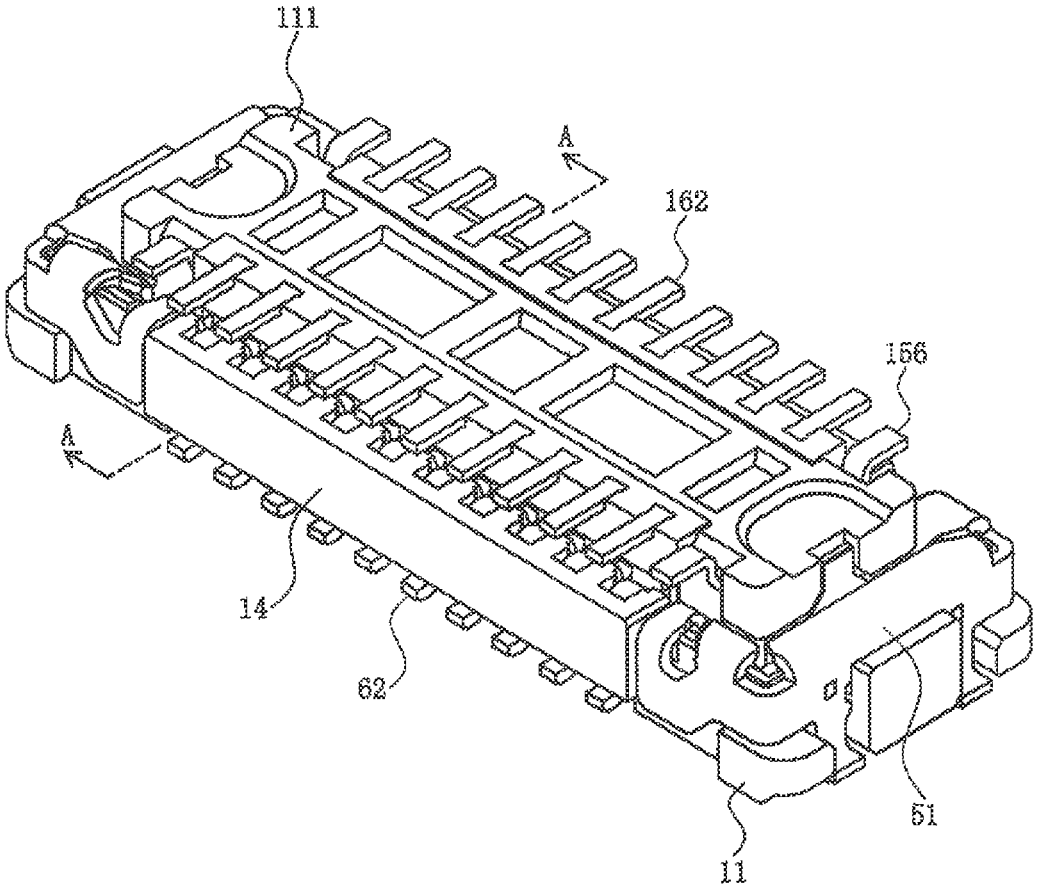
FIG. 4 is a drawing illustrating the completed state of the connector mating process of the present embodiment.

FIG. 3 is a perspective view illustrating the positional relationship between the first connector and the second connector during a connector mating process of the present embodiment, and FIG. 4 is a drawing illustrating the completed state of the connector mating process in the present embodiment.

Here, the first connector 1 is surface mounted to the first board by connecting the tail 62 of the first terminal 61 to a connection pad connected to a conductive trace of the first board not illustrated in the figures by soldering, or the like, and by connecting the board connecting part 56 of the first reinforcing bracket 51 to a connection pad connected to a conductive trace of the first board by soldering, or the like. Note that the conductive trace connected to the connection pad to which the tail 62 of the first terminal 61 is connected is a signal line, and that the conductive trace connected to the connection pad to which the board connecting part 56 of the first reinforcing bracket 51 is connected is a power line.

Likewise, the second connector 101 is surface mounted to the second board by connecting the tail 162 of the second terminal 161 to a connection pad connected to a conductive trace of the second board not illustrated in the figures by soldering, or the like, and by connecting the board connecting part 156 of the second reinforcing bracket 151 to a connection pad connected to a conductive trace of the second board by soldering, or the like. Note that the conductive trace connected to the connection pad to which the tail 162 of the second terminal 161 is connected is a signal line, and that the conductive trace connected to the connection pad to which the board connecting part 156 of the second reinforcing bracket 151 is connected is a power line.

First, in a state where an operator holds the mating surface of the first housing 11 of the first connector 1 and the mating surface of the second housing 111 of the second connector 101 opposite one another, as illustrated in FIG. 3, the alignment between the first connector 1 and the second connector 101 is complete when the position of the second protrusion 112 of the second connector 101 matches the position of the corresponding concave groove 12*a* of the first connector 1, and the position of the second protruding end part 122 of the second connector 101 matches the position of the corresponding mating recess 22 of the first connector 1.

When the first connector 1 and/or the second connector 101 is moved toward the other, that is, in a mating direction in this state, the second protrusion 112 and the second protruding end part 122 of the second connector 101 are inserted into the concave groove 12*a* and the mating recess 22 of the first connector 1. Thus, the first terminal 61 and the second terminal 161 achieve a conductive state when the first connector 1 and the second connector 101 are completed mated together, as illustrated in FIG. 4.

Next, the relationship between the first terminal 61 and the second terminal 161 in a state where the first connector 1 and the second connector 101 are completed mated to one another will be described in detail.

Figure 5:
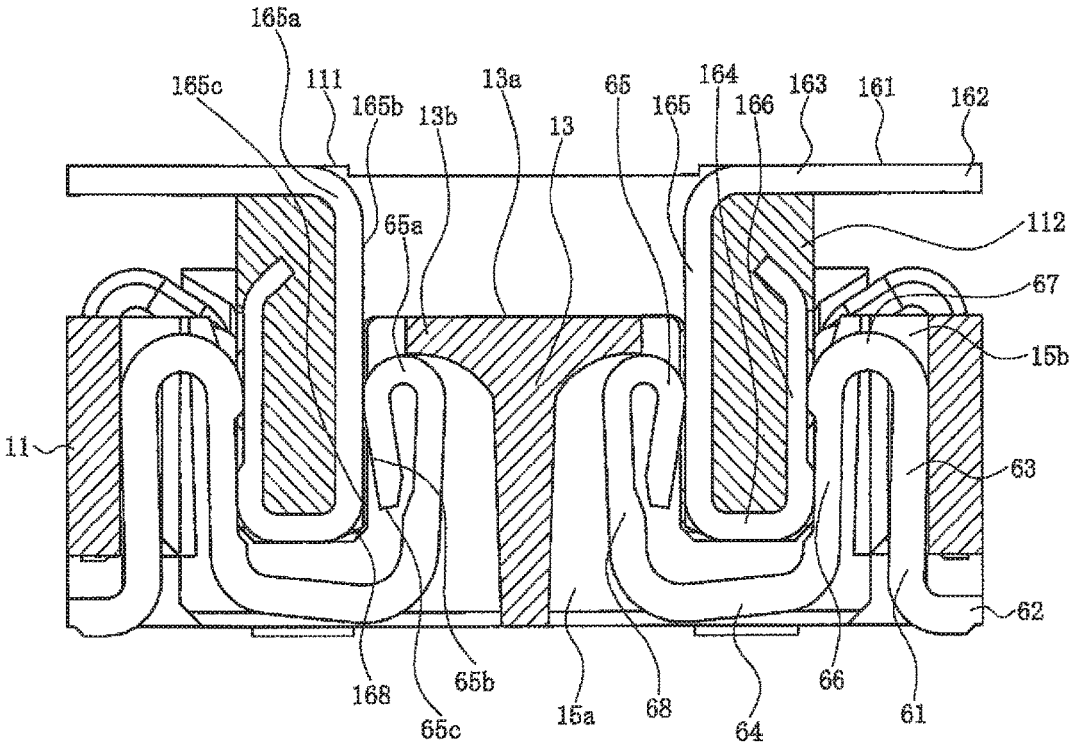
FIG. 5 is a cross sectional view illustrating a state where the connector mating is complete in the present embodiment, and is a view illustrating a cross section along line A-A in FIG. 4.

FIG. 5 is a cross sectional view illustrating a state where the connector mating is complete in the present embodiment, and is a view illustrating a cross section along line A-A in FIG. 4.

In the state where the first connector 1 and the second connector 101 are completely mated to one another, that is, in the completely mated state (mating completed state), each first terminal 61 is in the relationship illustrated in FIG. 5 with respect to the second terminal 161 corresponding thereto. Specifically, the second terminal 161 of the second connector 101 is inserted between the first contact part 65 and the second contact part 66 of each first terminal 61, the first contact part 65 of the first terminal 61 and the first contact part 165 of the second terminal 161 make contact, and the second contact part 66 of the first terminal 61 and the second contact part 166 of the second terminal 161 make contact. As a result, the conductive trace connected to the connection pad on the first board to which the tail 62 of the first terminal 61 is connected, and the conductive trace connected to the connection pad on the second board to which the tail 162 of the second terminal 161 is connected become conductive with one another.

Because at least part of the body part 163 and other parts are embedded in and thus integrally attached to the second housing 111 at the second terminal 161, as described above, the distance between the first contact part 165 and the second contact part 166 is substantially unchanged. On the other hand, while the part to be held 63 is held in and secured by the first housing 11, other parts thereof are not secured in the first housing 11. Furthermore, because the first contact part 65 and the second contact part 66 are mutually connected by the elastically deformable lower connecting part 64 and inner connecting part 68, the distance therebetween stretches elastically. Accordingly, because the second terminal 161 is in a state where the first contact part 165 and the second contact part 166 are clamped from both sides by the first contact part 65 and the second contact part 66 of the first terminal 61, the contact between the first contact part 65 of the first terminal 61 and the first contact part 165 of the second terminal 161, and the contact between the second contact part 66 of the first terminal 61 and the second contact part 166 of the second terminal 161 are securely maintained.

In the example illustrated in the figures, in a side view, the first contact part 65 of the first terminal 61 is a part with the overall shape of the letter J, and includes a substantially U shaped curved part 65*a* with one end connected to an upper end of the inner connecting part 68, a linear part 65*b* connected to the other end of the curved part 65*a* extending downward (insertion direction of the second protrusion 112) linearly, and a bottom end part 65*c*, which is the termination part of the linear part 65*b*. The curved part 65*a* is curved at least 180 degrees. Furthermore, at least the surface of the linear part 65*b* that faces the first contact part 165 of the second terminal 161 forms a straight line in a side view. The straight line is inclined with respect to the mating direction (insertion direction of the second protrusion 112) with the second connector 101, that is, with respect to the thickness direction of the first housing 11. Specifically, the incline is such that the line draws closer to the width direction center of the first housing 11 as the line draws closer to the bottom end part 65*c*.

Furthermore, the first protrusion 13 has a substantially T shaped cross section and is provided with a pair of left and right overhanging parts 13*b* that extend outward in the width direction from the width direction center of the first housing 11. The overhanging part 13*b* is a member for covering at least a part of an upper side (mating surface side) of the first terminal accommodating inner cavity 15*a* formed in both side surfaces of the first protrusion 13. Moreover, a lower surface of the overhanging portion 13*b* is brought into contact with or in proximity to an upper surface of the curved part 65*a* of the first contact part 65 accommodated in the first terminal accommodating inner cavity 15*a*. Accordingly, any upward displacement of the first contact part 65 is prevented by the overhanging part 13*b*, which keeps the first contact part 65 from sticking up from inside the first terminal accommodating inner cavity 15*a*. Note that the overhanging part 13*b* can be omitted when not needed.

In the example illustrated in the figures, in a side view, the first contact part 165 of the second terminal 161 includes a curved part 165*a* with one end connected to the body part 163, a linear part 165*b* connected to the other end of the curved part 165*a* extending downward linearly, and a bottom end part 165*c*, which is the termination part of the linear part 165*b*. Furthermore, at least the surface of the linear part 165*b* that faces the first contact part 65 of the first terminal 61 is a straight line in a side view. The straight line is parallel to the mating direction with the second connector 101, that is, parallel to the thickness direction of the second housing 111. Accordingly, with the first connector 1 and the second connector 101 in the completely mated state, the linear part 65*b* of the first contact part 65 of the first terminal 61 is inclined with respect to the first contact part 165 so as to draw further away from the first contact part 165 of the second terminal 161 the closer the linear part gets to the bottom end part 65*c*.

Moreover, seen in more detail, a transition surface part 168 is present on an outer surface of a connecting part between the first contact part 165 and the connecting part 164 of the second terminal 161, where the transition surface part 168 is an inclined or curved surface. That is, in a side view, the linear part 165*b* of the first contact part 165, which is a straight line, and the connecting part 164, which is a straight line orthogonal to the linear part 165*b*, are not connected at an apex having a right angle, but are rather connected through the transition surface part 168, which is an inclined straight line or a curved line. Accordingly, the bottom end part 165*c*, which is the termination part of the linear part 165*b*, is not a boundary with the connecting part 164, but rather a boundary with the transition surface part 168.

In the present embodiment, the position of the bottom end part 165*c* of the first contact part 165 of the second terminal 161 in the completely mated state is not below (in front of the insertion direction of the second protrusion 112) the position of the bottom end part 65*c* of the first contact part 65 of the first terminal 61, but rather above the position of the bottom end part 65*c*. That is, the bottom end part 165*c* of the first contact part 165 of the second terminal 161 is positioned more in front of the insertion direction of the second protrusion 112 than the bottom end part 65*c* of the linear part 65*b* of the first contact part 65 of the first terminal 61. Furthermore, in the completely mated state, there is a distance between a lower surface of the connecting part 164 of the second terminal 161 and an upper surface of the lower connecting part 64 of the first terminal 61. That is, the connecting part 164 of the second terminal 161 and the lower connecting part 64 of the first terminal 61 are separated and do not make contact with one another.

The operation for releasing the mating between the first connector 1 and the second connector 101 will be described next. A case of a mutual detachment operation, or so called oblique removal, where the second connector 101 is tilted in the width direction, that is, horizontally with respect to the first connector 1 when the mating is released so that the mating surfaces become inclined with respect to one another, will be described herein.

Figure 6B:
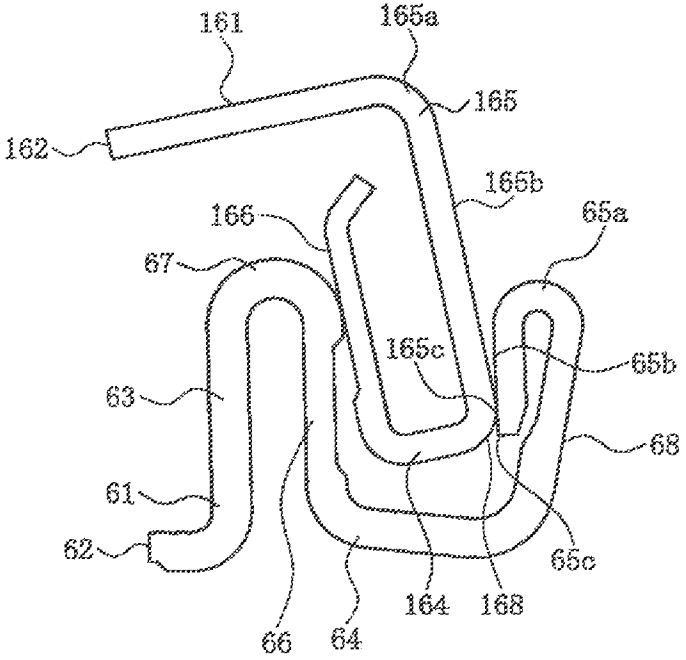
FIGS. 6A and 6B are diagrams illustrating the left sides of the first terminal and the second terminal in FIG. 5 to illustrate a state when an oblique removal of connector is performed in the present embodiment, where
Figure 6A:
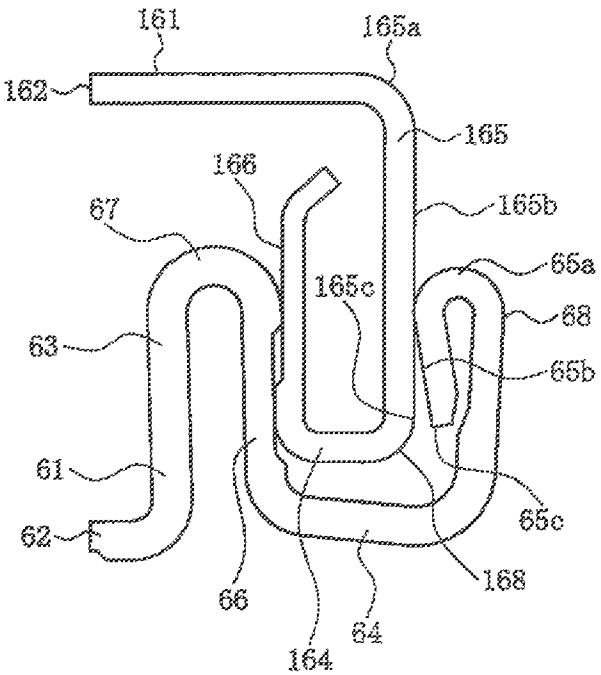
Figure 7:
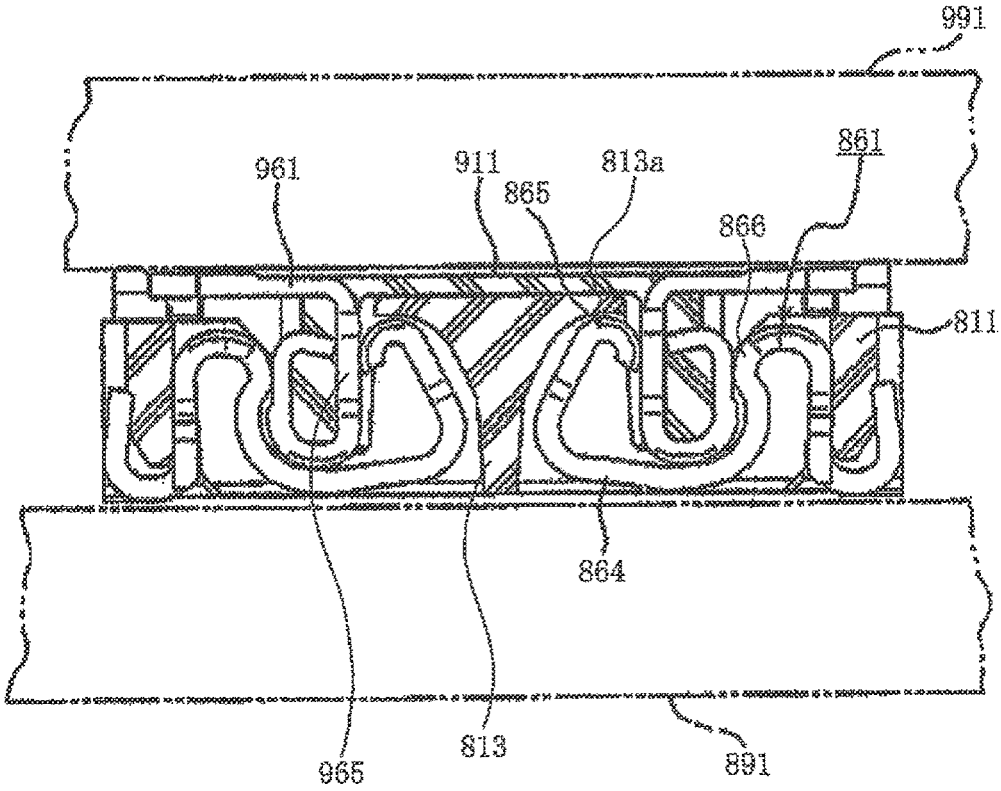
FIG. 7 Prior Art
FIG. 7 is a cross sectional view illustrating a conventional connector.

FIGS. 6A and 6B are views illustrating a state when the oblique removal of a connector is performed in the present embodiment, and are views illustrating the left sides of the first terminal and the second terminal in FIG. 5. Note that, in the figures, FIG. 6A is a view illustrating the first terminal and the second terminal in the completely mated state, and FIG. 6B is a view illustrating the first terminal and the second terminal at the time the oblique removal is started.

Heretofore, the operation for releasing the mating between the first connector 1 and the second connector 101 is to pull the first connector 1 and/or the second connector 101 from the other connector, that is, to move the connector in a removal direction while each of the mating surfaces are being held mutually parallel to one another. However, for various reasons, it is difficult for an operator to move the first connector 1 and/or the second connector 101 in a removal direction while the mating surfaces are being held in a state where they are parallel to one another, such reasons including that the first connector 1 and the second connector 101 are very small compared to the hands, fingers, and the like, of the operator, or that the first connector 1 and the second connector 101 are hard to see because the surface areas of the first board and the second board, on which the first connector 1 and the second connector 101 are mounted, are so much larger than the areas of the mounting surfaces of the first connector 1 and the second connector 101. Therefore, oblique removal is typically performed.

Here, in the example illustrated in FIG. 5, a description of the oblique removal is given where the second connector 101 is pulled and removed from the first connector 1 by inclining the second connector 101 in a counterclockwise direction relative to the first connector 1, that is, by lifting the right end of the second connector 101 higher than the left end thereof.

When the oblique removal is performed from the completely mated state, the postures of the first terminal 61 and the second terminal 161 located on the left side in FIG. 5 change from those illustrated in FIG. 6A to those illustrated in FIG. 6B. That is, the second terminal 161 is rotated counterclockwise relative to the first terminal 61. Therefore, the part in the vicinity of the bottom end part 165*c* in the linear part 165*b* of the first contact part 165 of the second terminal 161 that was separated from the linear part 65*b* of the first contact part 65 of the first terminal 61 in the completely mated state, as illustrated in FIG. 6A, makes contact with the linear part 65*b* of the first contact part 65 of the first terminal 61, as illustrated in FIG. 6B.

As was stated above, in the completely mated state, the bottom end part 165*c* of the first contact part 165 of the second terminal 161 is positioned either level with or above the bottom end part 65*c* of the first contact part 65 of the first terminal 61. Accordingly, even if the second terminal 161 is rotated counterclockwise relative to the first terminal 61 from the state illustrated in FIG. 6A, the first contact part 165 of the second terminal 161 makes contact with the linear part 65*b* positioned above the bottom end part 65*c* without making contact with the bottom end part 65*c* in the first contact part 65 of the first terminal 61. Furthermore, when the second terminal 161 is further rotated counterclockwise relative to the first terminal 61, the first contact part 165 of the second terminal 161 moves upward along the linear part 65*b* while making sliding contact with the linear part 65*b*.

Because the first contact part 165 of the second terminal 161 makes sliding contact with the linear part 65*b* of the first contact part 65 of the first terminal 61 and thus moves smoothly upward along the linear part 65*b* in this way, even when the oblique removal rotates the second terminal 161 counterclockwise relative to the first terminal 61, the first contact part 65 of the first terminal 61 is not subjected to a large upward force from the first contact part 165 of the second terminal 161. Accordingly, the first contact part 65 of the first terminal 61 is not wound up.

If the bottom end part 165*c* of the first contact part 165 of the second terminal 161 were positioned below the bottom end part 65*c* of the first contact part 65 of the first terminal 61 in the completely mated state and the oblique removal rotated the second terminal 161 counterclockwise relative to the first terminal 61, the first contact part 165 of the second terminal 161 would be unable to move upward smoothly along the linear part 65*b* of the first contact part 65 when making contact with the first contact part 65 of the first terminal, and would thus push the linear part 65*b* upward. Thus, the first contact part 65 of the first terminal 61 would be subjected to a large upward force from the first contact part 165 of the second terminal 161, and be wound up.

By contrast, because the first contact part 165 of the second terminal 161 moves smoothly upward along the linear part 65*b* of the first contact part 65 of the first terminal 61 in the present embodiment, the first contact part 65 of the first terminal 61 is not subjected to a large upward force, even when the oblique removal rotates the second terminal 161 counterclockwise relative to the first terminal 61. Accordingly, the first contact part 65 of the first terminal 61 is not wound up. Furthermore, because the overhanging part 13*b* is present above the curved part 65*a* of the first contact part 65 of the first terminal 61, the first contact part 65 of the first terminal 61 is prevented from displacing upward by the overhanging part 13*b*, even when the part is subjected to upward force from the first contact part 165 of the second terminal 161. Accordingly, this more effectively prevents the first contact part 65 of the first terminal 61 from being wound up.

In this way, the present embodiment provides the first connector 1 that includes a connector, the first terminal 61, and the first housing 11 in which is formed the concave groove 12*a* in which the first terminal 61 is disposed, and the second connector 101 that includes the second terminal 161 which makes contact with the first terminal 61, and the second housing 111 in which the second terminal 161 is disposed, and in which is the second protrusion 112, which is inserted into the concave groove 12*a*, is formed. Furthermore, the first terminal 61 includes the first contact part 65 disposed on one side surface of the concave groove 12*a*, and the second contact part 66 disposed on the other side surface of the concave groove 12*a*; the first contact part 65 includes the linear part 65*b* that extends linearly in the insertion direction of the second protrusion 112, and the bottom end part 65*c* of the linear part 65*b*; the second terminal 161 includes the first contact part 165 that is disposed on one side surface of the second protrusion 112 and makes contact with the first contact part 65 of the first terminal 61, and the second contact part 166 that is disposed on the other side surface of the second protrusion 112 and makes contact with second contact part 66 of the first terminal 61; the first contact part 165 includes the linear part 165*b* that extends linearly in the insertion direction of the second protrusion 112, and the bottom end part 165*c* of the linear part 165*b*, where, when the second protrusion 112 is inserted into the concave groove 12*a* and the first connector 1 and the second connector 101 achieve the completely mated state, the bottom end part 165*c* of the linear part 165*b* of the first contact part 165 of the second terminal 161 is positioned more in front of the insertion direction of the second protrusion 112 than the bottom end part 65*c* of the linear part 65*b* of the first contact part 65 of the first terminal 61.

Therefore, the first contact part 165 of the second terminal 161 moves smoothly upward along the linear part 65*b* while making sliding contact with the linear part 65*b* of the first contact part 65 of the first terminal 61, even if the oblique removal rotates the second terminal 161 relative to the first terminal 61 during the work to release the mating between the first connector 1 and the second connector 101. Accordingly, the first contact part 65 of the first terminal 61 is not subjected to a large upward force from the first contact part 165 of the second terminal 161, and is not wound up.

Moreover, the first contact part 65 of the first terminal 61 has a substantially J shape, and the bottom end part 65*c* of the linear part 65*b* of the first contact part 65 is a free end that does not make contact with the first contact part 165 of the second terminal 161 in the completely mated state.

Furthermore, the first contact part 65 of the first terminal 61 includes the curved part 65*a* in contact with an end part on the opposite side of the bottom end part 65*c* in the linear part 65*c*, and the first housing 11 includes the overhanging part 13*b* that is in contact with or in proximity to the curved part 65*a*. Because the first contact part 65 of first terminal 61 is thus prevented from displacing upward by the overhanging part 13*b* even when subjected to upward force from the first contact part 165 of the second terminal 161, the first contact part 65 of the first terminal 61 is more effectively kept from winding up.

Furthermore, the first terminal 61 includes the lower connecting part 64 disposed in a bottom part of the concave groove 12*a* for connecting the first contact part 65 and the second contact part 66; the second terminal 161 includes the connecting part 164 disposed on a tip part of the second protrusion 112 for connecting the first contact part 165 and the second contact part 166; and the lower connecting part 64 and the connecting part 164 are separated from one another in the completely mated state.

Note that the disclosure of the present specification describes characteristics related to preferred and exemplary embodiments. Various other embodiments, modifications and variations within the scope and spirit of the claims appended hereto could naturally be conceived of by persons skilled in the art by summarizing the disclosures of the present specification.

The present disclosure can be applied to connectors.

The invention claimed is:

1. A connector, comprising:

a first connector that includes a first terminal, and a first housing in which an insertion recess in which the first terminal is disposed is formed; and a second connector that includes a second terminal in contact with the first terminal, and a second housing in which the second terminal is disposed, and in which an insertion protrusion to be inserted into the insertion recess is formed, wherein the first terminal includes a first contact part disposed on one side surface of the insertion recess and a second contact part disposed on the other side surface of the insertion recess, and the first contact includes a linear part extending linearly in an insertion direction of the insertion protrusion, and a termination part of the linear part, wherein the second terminal includes a first contact part disposed on one side surface of the insertion protrusion and in contact with the first contact part of the first terminal, and a second contact part disposed on the other side surface of the insertion protrusion and in contact with the second contact part of the first terminal, and the first contact part includes a linear part extending linearly in an insertion direction of the insertion protrusion, and a termination part of the linear part, and wherein, when the insertion protrusion is inserted into the insertion recess and the first connector and the second connector are in a completely mated state, the termination part of the linear part of the first contact part of the second terminal is positioned more in front side of an insertion direction of the insertion protrusion than the termination part of the linear part of the first contact part of the first terminal.

2. The connector according to claim 1, wherein the first contact part of the first terminal has a substantially J shape, and the termination part of the linear part of the first contact part is a free end that does not make contact with the first contact part of the second terminal in the completely mated state.

3. The connector according to claim 1, wherein the first contact part of the first terminal includes a curved part in contact with an end part on the opposite side of the termination part in the linear part, and the first housing includes an overhanging part that is in contact with or in proximity to the curved part.

4. The connector according to claim 1, wherein the first terminal includes a first connecting part disposed in a bottom part of the insertion recess for connecting the first contact part and the second contact part, the second terminal includes a second connecting part disposed on a tip part of the insertion protrusion for connecting the first contact part and the second contact part, and the first connecting part and the second connecting part are separated from one another in the completely mated state.

* * * * *